US012780590B2

(12) United States Patent
Yamada et al.

(10) Patent No.: US 12,780,590 B2
(45) Date of Patent: Nov. 3, 2026

(54) POST-PROCESSING APPARATUS AND IMAGE FORMING SYSTEM

(71) Applicants: Jun Yamada, Kanagawa (JP); Yuusuke Shibasaki, Kanagawa (JP); Yusuke Hirono, Kanagawa (JP); Atsushi Shinoda, Kanagawa (JP); Shuuto Tohkaishi, Kanagawa (JP); Sho Asano, Kanagawa (JP); Wataru Takahashi, Kanagawa (JP); Tomomichi Hoshino, Kanagawa (JP); Kotomi Kameyama, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Hirotaka Yasukawa, Kanagawa (JP); Yoshito Suzuki, Kanagawa (JP); Shinya Monma, Kanagawa (JP); Takahiro Watanabe, Kanagawa (JP); Yuji Suzuki, Kanagawa (JP); Wataru Nozaki, Kanagawa (JP); Yohsuke Haraguchi, Kanagawa (JP); Naohiro Yoshida, Kanagawa (JP)

(72) Inventors: Jun Yamada, Kanagawa (JP); Yuusuke Shibasaki, Kanagawa (JP); Yusuke Hirono, Kanagawa (JP); Atsushi Shinoda, Kanagawa (JP); Shuuto Tohkaishi, Kanagawa (JP); Sho Asano, Kanagawa (JP); Wataru Takahashi, Kanagawa (JP); Tomomichi Hoshino, Kanagawa (JP); Kotomi Kameyama, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Hirotaka Yasukawa, Kanagawa (JP); Yoshito Suzuki, Kanagawa (JP); Shinya Monma, Kanagawa (JP); Takahiro Watanabe, Kanagawa (JP); Yuji Suzuki, Kanagawa (JP); Wataru Nozaki, Kanagawa (JP); Yohsuke Haraguchi, Kanagawa (JP); Naohiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 18/937,237

(22) Filed: Nov. 5, 2024

(65) Prior Publication Data

US 2025/0206560 A1 Jun. 26, 2025

(30) Foreign Application Priority Data

Dec. 26, 2023 (JP) ..... 2023-218974

(51) Int. Cl.
*B65H 37/04* (2006.01)

(52) U.S. Cl.
CPC ..... *B65H 37/04* (2013.01); *B65H 2301/4213* (2013.01); *B65H 2801/27* (2013.01)

(58) Field of Classification Search
CPC .... B31F 5/001; B31F 5/02; B31F 2201/0754; G03G 15/6541; G03G 15/6514;
(Continued)

(56) References Cited

U.S. PATENT DOCUMENTS

| | | | | |
|---|---|---|---|---|
| 5,213,317 | A * | 5/1993 | Mandel | B42C 9/0056 270/58.11 |
| 6,213,456 | B1 * | 4/2001 | Hirano | G03G 15/6541 270/58.11 |
| 8,104,757 | B2 * | 1/2012 | Taki | B65H 37/04 270/58.11 |
| 2012/0083400 | A1 | 4/2012 | Shibasaki et al. | |
| 2012/0153556 | A1 | 6/2012 | Sugiyama et al. | |
| 2013/0113154 | A1 | 5/2013 | Furuhashi et al. | |

(Continued)

FOREIGN PATENT DOCUMENTS

JP 2019-130820 A 8/2019

*Primary Examiner* — Leslie A Nicholson, III

(74) *Attorney, Agent, or Firm* — Harness, Dickey & Pierce, P.L.C.

(57) ABSTRACT

A post-processing apparatus includes a manual feed processing unit and a binder. A sheet bundle including a plurality of sheets stacked is manually fed into the manual feed processing unit. The binder binds a leading end of the (Continued)

sheet bundle downstream in a manual feed direction of the sheet bundle in a state where the sheet bundle is manually fed into the manual feed processing unit. The manual feed processing unit includes a guide. The guide includes a bending guide portion to bend a portion upstream from the leading end of the sheet bundle in the manual feed direction.

20 Claims, 12 Drawing Sheets

(58) Field of Classification Search
CPC ..... G03G 2215/00827; G03G 2215/00852; G03G 2215/0086; B65H 37/04; B65H 2301/43828; B65H 2301/4213; B65H 2301/4214; B65H 2301/42146; B65H 2301/51616; B65H 2301/51611
USPC ..... 270/58.07, 58.08
See application file for complete search history.

(56) References Cited

U.S. PATENT DOCUMENTS

| | | | |
|---|---|---|---|
| 2014/0138896 | A1 | 5/2014 | Yoshida et al. |
| 2014/0203487 | A1 | 7/2014 | Hoshino et al. |
| 2014/0203488 | A1 | 7/2014 | Hidaka et al. |
| 2014/0213425 | A1 | 7/2014 | Sugiyama et al. |
| 2015/0360899 | A1 | 12/2015 | Takahashi et al. |
| 2016/0340144 | A1 | 11/2016 | Sakano et al. |
| 2016/0340145 | A1 | 11/2016 | Kunieda et al. |
| 2016/0360053 | A1 | 12/2016 | Suzuki et al. |
| 2017/0174465 | A1 | 6/2017 | Morinaga et al. |
| 2017/0217239 | A1 | 8/2017 | Suzuki et al. |
| 2018/0259895 | A1 | 9/2018 | Shibasaki et al. |
| 2020/0307944 | A1 | 10/2020 | Shibasaki et al. |
| 2020/0307945 | A1 | 10/2020 | Mori et al. |
| 2021/0403273 | A1 | 12/2021 | Haraguchi et al. |
| 2022/0289512 | A1 | 9/2022 | Takahashi et al. |
| 2022/0334523 | A1 | 10/2022 | Akiyama et al. |

* cited by examiner

POST-PROCESSING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2023-218974, filed on Dec. 26, 2023, in the Japan Patent Office, the entire disclosure of which is hereby incorporated by reference herein.

BACKGROUND

Technical Field

The present disclosure relates to a post-processing apparatus that performs post-processing on a sheet, and an image forming system including the post-processing apparatus and an image forming apparatus.

Related Art

An image forming system (image forming apparatus) is known that includes a post-processing apparatus to perform binding processing (post-processing) on a sheet bundle inserted manually.

For example, a post-processing apparatus is installed in the exterior of an image forming apparatus, and is configured to execute binding processing on a corner portion of a sheet bundle manually inserted by a user.

SUMMARY

According to an embodiment of the present disclosure, a post-processing apparatus includes a manual feed processing unit and a binder. a sheet bundle including a plurality of sheets stacked is manually fed into the manual feed processing unit. The binder binds a leading end of the sheet bundle downstream in a manual feed direction of the sheet bundle in a state where the sheet bundle is manually fed into the manual feed processing unit. The manual feed processing unit includes a guide. The guide includes a bending guide portion to bend a portion upstream from the leading end of the sheet bundle in the manual feed direction.

According to another embodiment of the present disclosure, an image forming system includes an image forming apparatus to form an image on a sheet; and the post-processing apparatus.

BRIEF DESCRIPTIONS OF THE DRAWINGS

A more complete appreciation of embodiments of the present disclosure and many of the attendant advantages and features thereof can be readily obtained and understood from the following detailed description with reference to the accompanying drawings, wherein.

Figure 1:
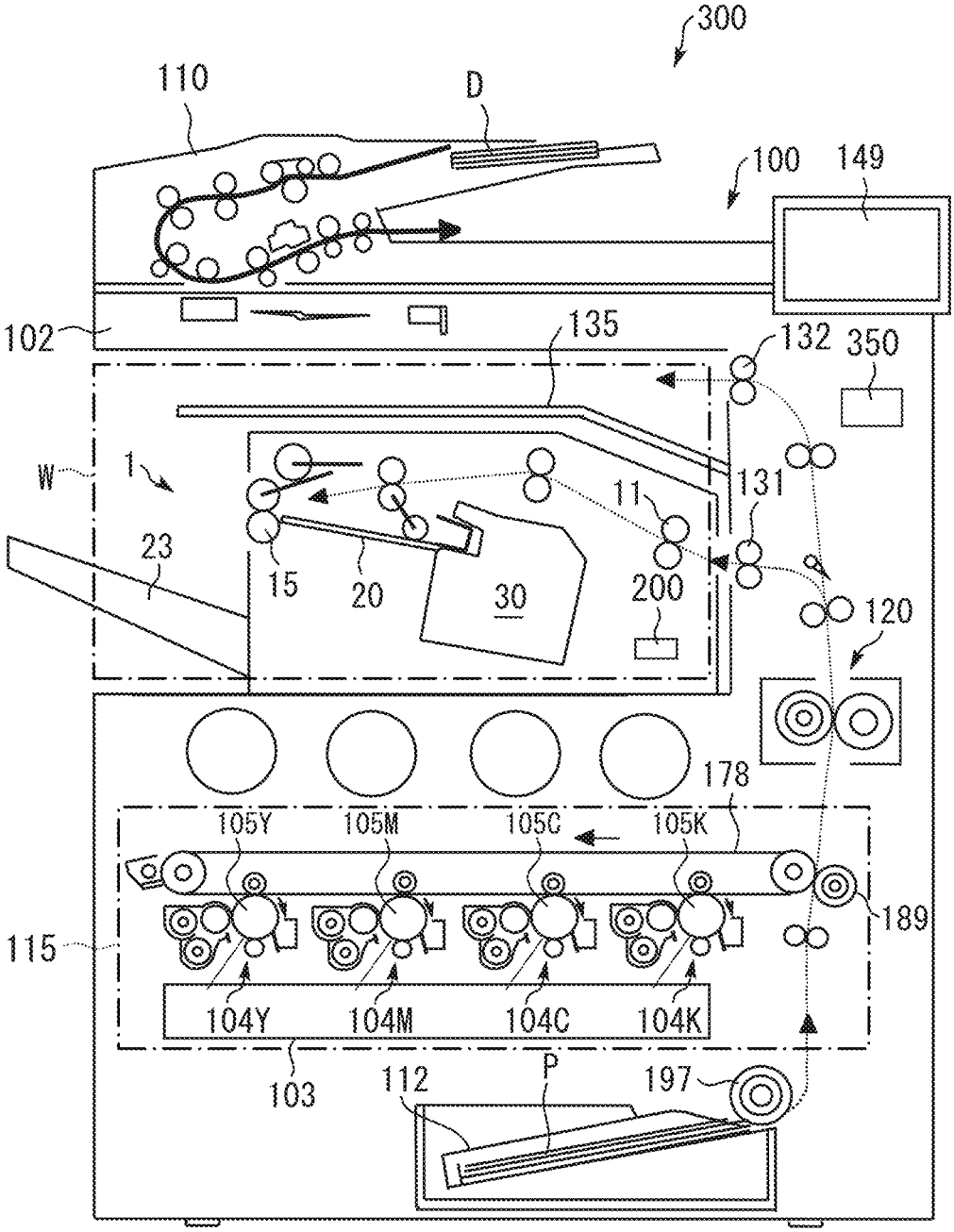
FIG. 1 is a diagram illustrating the overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DESCRIPTIONS OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, embodiments of the present disclosure are described in detail with reference to the drawings. Identical reference numerals are assigned to identical or equivalent components and a description of those components may be simplified or omitted.

An image forming system 300 in the present embodiment is described with reference to FIG. 1.

As illustrated in FIG. 1, in the image forming system 300 in the present embodiment, a post-processing apparatus 1 (sheet processing apparatus) having a binding processing function is detachably installed in an in-body space W (a space provided between a document reading device 102 and an image forming unit 115) of an image forming apparatus 100. The in-body space W is a space to which a sheet P (the sheet P after printing) ejected from the image forming apparatus 100 can be ejected, and is also a space from which the ejected sheet P is removable. That is, in a state where the post-processing apparatus 1 is not installed, the in-body space W functions as a space (ejection section) in which the sheet P ejected from the image forming apparatus 100 is stacked.

In the image forming system 300, the image forming apparatus 100 is a portion other than the post-processing apparatus 1, and mainly includes the image forming unit 115, a main body feeding tray 112, a fixing unit 120, a document conveying device 110, the document reading device 102, and the like. An operation display panel 149 (operation display) for displaying various types of information in the image forming system 300 and for inputting various commands is installed on the exterior of the image forming apparatus 100 (image forming system 300).

With reference to FIGS. 1 to 5B, the post-processing apparatus 1 is provided with a staple binding device 30, an internal tray 20, an ejection roller pair 15, an ejection tray 23, a plurality of conveying roller pairs 11 to 13, a stapleless binding device 40, and the like.

Here, the post-processing apparatus 1 is disposed on the downstream side of the image forming apparatus 100 in a conveyance direction (a conveyance direction of the sheet P). The post-processing apparatus 1 is an apparatus for performing binding processing (staple binding processing or stapleless binding processing) on a plurality of sheets P after printing ejected from the image forming apparatus 100, or performing binding processing (staple binding processing) on a sheet bundle PT set manually, which will be described later in detail.

Hereinafter, a description is given of an image forming operation (printing operation) in the image forming apparatus 100 of the image forming system 300, with reference to FIG. 1.

In the image forming apparatus 100, first, an original document D is conveyed (fed) in an arrow direction in the figure by conveying rollers of the document conveying device 110, and passes over the document reading device 102. At this time, the document reading device 102 optically reads image information of the original document D passing over the document reading device 102.

Then, optical image information read by the document reading device 102 is converted into an electrical signal, and then transmitted to a writing device 103. Then, the writing device 103 emits laser beams based on the electrical signal image information onto photoconductor drums 105Y, 105M, 105C, and 105K for respective colors, to perform an exposing process.

Then, a charging process, the exposing process, and a developing process are performed on the photoconductor drums 105Y, 105M, 105C, and 105K of respective image forming units 104Y, 104M, 104C, and 104K to form desired images on the photoconductor drums 105Y, 105M, 105C, and 105K, respectively.

Thereafter, the images respectively formed on the photoconductor drums 105Y, 105M, 105C, and 105K are transferred and superimposed onto an intermediate transfer belt 178 to form a color image. Furthermore, the color image formed on the intermediate transfer belt 178 is transferred onto the sheet P fed and conveyed by a feeding roller 197 from the main body feeding tray 112 (second feeding unit) at a position opposed to a secondary transfer roller 189.

Thereafter, the sheet P to which the color image is transferred is conveyed to a position of the fixing unit 120. Then, the color image transferred on the surface is fixed on the sheet P.

Thereafter, on the basis of selection of a print mode by the user, the sheet P is ejected from the image forming apparatus 100 by a first ejection roller pair 131 and fed into the post-processing apparatus 1, or ejected from the image forming apparatus 100 by a second ejection roller pair 132 and stacked on an ejection tray 135.

Here, in the present embodiment, the post-processing apparatus 1 is connected (installed) in the in-body space W of the image forming apparatus 100, and the sheet P ejected from the image forming apparatus 100 is conveyed to the post-processing apparatus 1 on the basis of user's selection, and post-processing is performed on the conveyed sheet P.

By installing the post-processing apparatus 1 in the in-body space W of the image forming apparatus 100, the in-body space W is effectively used, and the image forming system 300 can be downsized.

Figure 2:
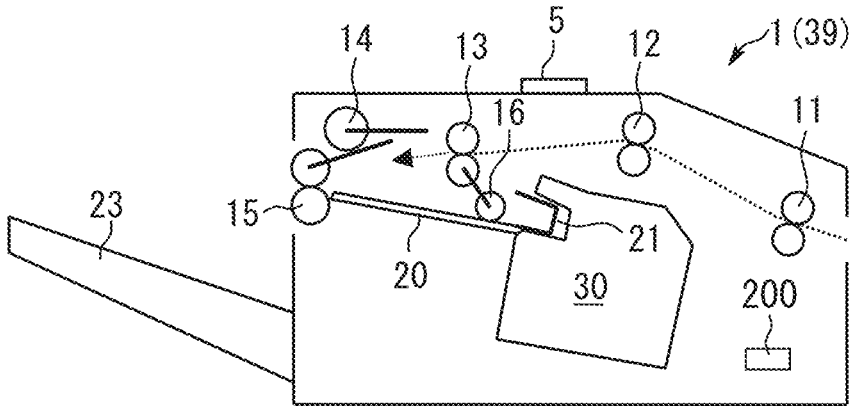
FIG. 2 is a diagram illustrating a configuration of an automatic processing device of a post-processing apparatus in the image forming system of FIG. 1.

With reference to FIG. 2, the post-processing apparatus 1 (automatic processing device 39) in the present embodiment is configured to convey the sheet P fed from the image forming apparatus 100 to a conveyance path (that is a conveyance path indicated by a broken line in the figure, in which three conveying roller pairs 11 to 13 are installed), perform post-processing such as binding processing, or eject the sheet P as it is without performing the post-processing.

Specifically, in a case where a mode not performing the post-processing is selected, the sheet P conveyed by the first to third conveying roller pairs 11 to 13 is ejected by the ejection roller pair 15 and placed on the ejection tray 23.

In a case where a "sort mode (sorting processing mode)" is selected, the sheet P is conveyed while being shifted in a width direction by a predetermined amount for each sheet P by the ejection roller pair 15 configured to be movable in the width direction (a direction perpendicular to the paper surface of FIG. 2), and is sequentially stacked on the ejection tray 23.

In a case where a "binding processing mode (staple mode)" is selected, the sheets P conveyed by the first to third conveying roller pairs 11 to 13 are sequentially stacked on the internal tray 20 without being ejected by the ejection roller pair 15. At this time, each time the sheet P is placed on the internal tray 20, a tapping roller 14 and a return roller 16 disposed above the sheet P move from standby positions to positions where the rollers abut on the sheet P (that is the uppermost sheet P in the sheet bundle PT), and the tapping roller 14 and the return roller 16 are rotationally driven in the counterclockwise direction in FIG. 2, so that the sheet P is conveyed (moved) toward an end fence 21. As a result, rear ends (rear ends in the conveyance direction) of the plurality of sheets P (sheet bundle PT) abut the end fence 21, and positions of the plurality of sheets P are aligned in the conveyance direction.

Figure 3:
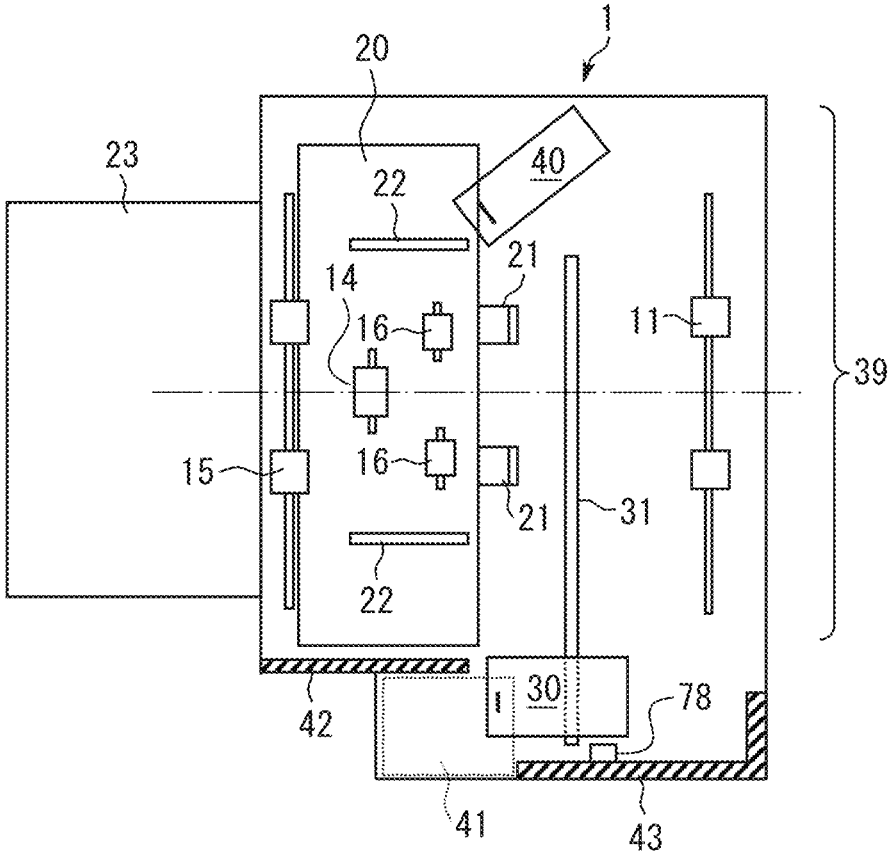
FIG. 3 is a top view of a post-processing apparatus.

At this time, with reference to FIG. 3, jogger fences 22 (side fences) installed at both end portions in the width direction of the internal tray 20 move in the width direction so as to sandwich the sheet P (sheet bundle PT) every time the sheet P is placed on the internal tray 20 (or after a desired number of sheets P are stacked), and positions of the sheets P (sheet bundle PT) are aligned in the width direction. Then, the binding processing is performed by the staple binding device 30 (or the stapleless binding device 40) on the rear ends of the sheets P (sheet bundle PT) aligned in each of the conveyance direction and the width direction.

Thereafter, the sheets P (sheet bundle PT) subjected to the binding processing moves obliquely upward along the tray surface of the internal tray 20 by reverse rotation (rotation in the clockwise direction in FIG. 2) of the return roller 16, and is ejected onto the ejection tray 23 by conveyance by the ejection roller pair 15.

Note that the post-processing apparatus 1 in the present embodiment is provided with two binding devices (that are the staple binding device 30 and the stapleless binding device 40), and the user can select one of types of the binding processing.

The staple binding device 30 as a binding device is configured to perform binding processing (staple binding processing) using a staple (metal staple) on the sheet bundle PT, and a known one can be used.

In the present embodiment, the staple binding device 30 is configured to be movable in the width direction along a guide rail 31 extending in the width direction (that is a direction perpendicular to the paper surface of FIG. 2, and is a vertical direction of FIG. 3) by a moving mechanism. As a result, the binding processing can be performed at a desired position in the width direction with respect to the sheet bundle PT placed on the internal tray 20.

In particular, the staple binding device 30 is configured to be movable to a position of a manual feed processing unit 41 to be described later, so that the binding processing can be performed in the manual feed processing unit 41.

On the other hand, the stapleless binding device 40 is configured to perform the binding processing by a binding tool 400 without using a staple (metal staple).

Figure 4:
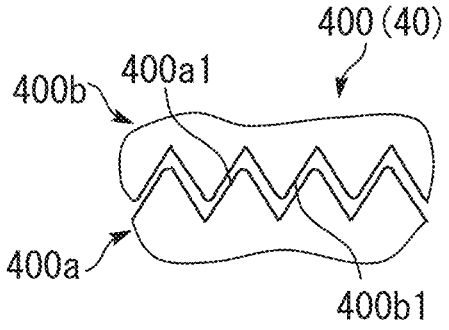
FIG. 4 is an enlarged view of a binding tool of a stapleless binding device.

Specifically, with reference to FIG. 4, the stapleless binding device 40 is provided with the binding tool 400 including two members, a first member 400*a* and a second member 400*b*, having tooth-shaped uneven portions 400*al* and 400*b*1. Then, the binding tool 400 presses the tooth-shaped uneven portions 400*a*1 and 400*b*1 against a corner portion PTx (see FIGS. 8 and 9) of the sheet bundle PT inserted into the manual feed processing unit 41 to form unevenness in the thickness direction in the sheet bundle PT, and causes the sheets P to mesh with each other to perform a binding processing operation.

In the binding tool 400, the first member 400*a* and the second member 400*b* are disposed in a substantially vertical direction. The first member 400*a* is formed with the tooth-shaped uneven portion 400*al* on the upper surface. The second member 400*b* is formed with the tooth-shaped uneven portion 400*b*1 meshing with the tooth-shaped uneven portion 400*al* of the first member 400*a* on the lower surface, and is configured to be relatively movable with respect to the first member 400*a* so as to sandwich the sheet bundle PT with the first member 400*a*. Then, the binding processing operation is performed in a state where the sheet bundle PT is sandwiched between the first member 400*a* and the second member 400*b*.

In the present embodiment, the stapleless binding device 40 is configured to be movable in the width direction between a standby position (that is a position illustrated in FIG. 3) and a processing position (that is a position of a corner portion of the sheet bundle PT placed on the internal tray 20) by a moving mechanism. As a result, the binding processing can be performed on the corner portion of the sheet bundle PT placed on the internal tray 20.

Hereinafter, a characteristic configuration and operation of the post-processing apparatus 1 in the present embodiment will be described in detail.

As described above with reference to FIGS. 1 to 3 and the like, the post-processing apparatus 1 in the present embodiment is provided with the automatic processing device 39 that stacks a plurality of sheets P ejected from the image forming apparatus 100 and fed to the post-processing apparatus 1 to form a sheet bundle PT and then performs the binding processing (that is the staple binding processing or the stapleless binding processing) on the sheet bundle PT.

Apart from such an automatic processing device 39, the post-processing apparatus 1 in the present embodiment is provided with the manual feed processing unit 41 for performing the binding processing on a sheet bundle PT set manually (by manual feed) by the user. That is, the manual feed processing unit 41 is a portion to which a sheet bundle PT formed by stacking a plurality of sheets P is manually fed.

Specifically, in the post-processing apparatus 1 installed in the in-body space W of the image forming system 300, the manual feed processing unit 41 allows the user to insert a sheet bundle PT from the front side (the side that can face the operation display panel 149) and performs the binding processing on a binding processing portion M (see FIGS. 7A to 7F) at the corner portion of the sheet bundle PT.

As described above, the staple binding device 30 as the binding device performs the binding processing on a leading end (that is a right end portion of FIGS. 5A to 6) on the downstream side in a manual feed direction of a sheet bundle PT in the state of being manually fed into the manual feed processing unit 41.

Figure 5A:
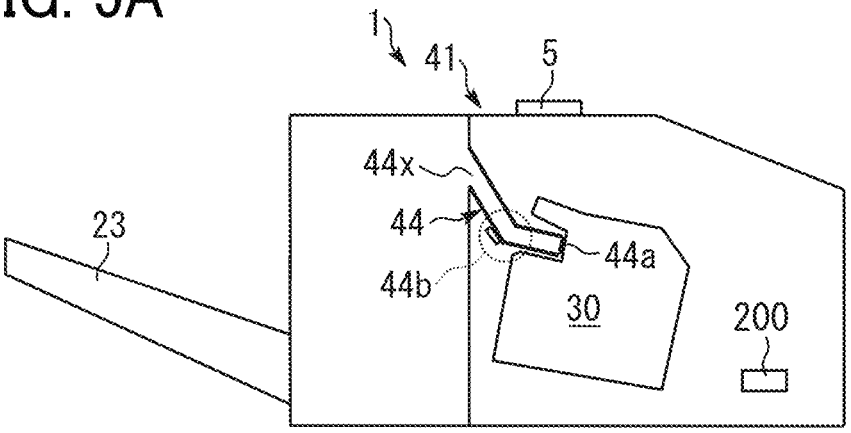
FIGS. 5A and 5B are diagrams illustrating a manual feed processing unit in a post-processing apparatus.
Figure 5B:
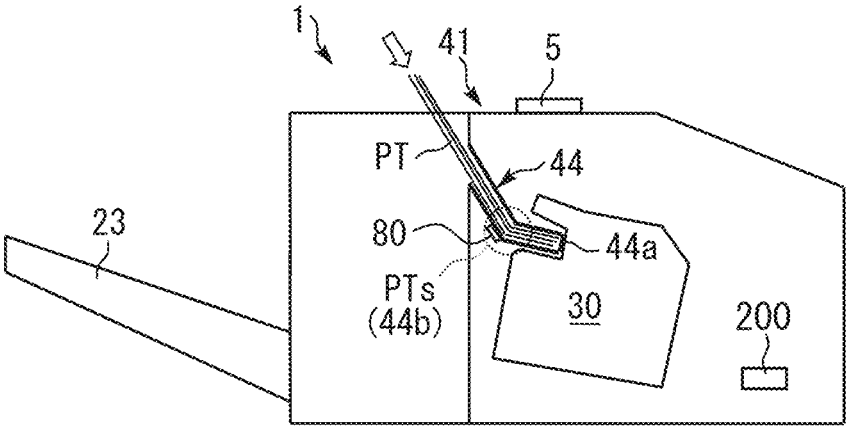

Note that when the binding processing in the manual feed processing unit 41 is executed (when the sheet bundle PT is detected by a sheet bundle detection sensor 80 illustrated in FIG. 5B), the staple binding device 30 in the present embodiment moves to the position of the manual feed processing unit 41 (that is the position illustrated in FIG. 3) along the guide rail 31 as described above with reference to FIG. 3. Further, this position is detected by a staple home position (HP) sensor 78 (see FIGS. 3 and 8).

Figure 6:
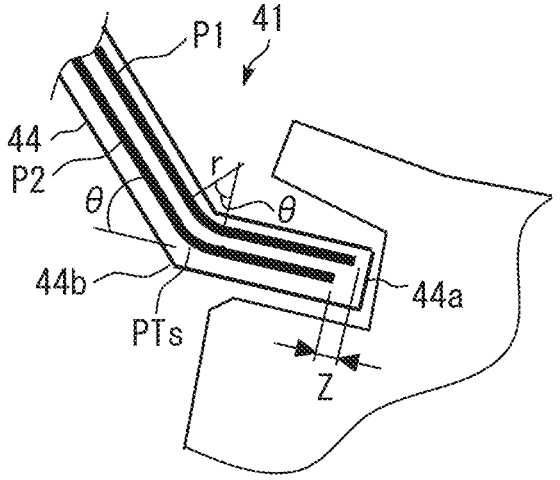
FIG. 6 is an enlarged view of a part of a manual feed processing unit.

Here, with reference to FIGS. 5A to 6, and the like, in the present embodiment, the manual feed processing unit 41 is provided with a guide 44 for guiding the sheet bundle PT when the sheet bundle PT is manually fed. The guide 44 is formed with a bending guide portion 44*b* that bends a portion on the upstream side in the manual feed direction from the leading end (that is a portion where the binding processing portion M is to be formed) as the bent portion PTs while guiding the sheet bundle PT when the sheet bundle PT is manually fed.

Specifically, a part of the manual feed processing unit 41 is formed in a box shape, and the guide 44 is provided therein. The guide 44 is formed so as to sandwich the sheet bundle PT inserted from an insertion port 44*x* (slit) from the front surface side and the back surface side of the sheet bundle PT. That is, in the present embodiment, it can be said that the guide 44 is a space formed inside a box shape and is configured as a part of a box-shaped member.

The bending guide portion 44*b* is a portion where ends of two planar guide portions are connected to each other at a predetermined angle (bending angle θ). That is, as illustrated in FIGS. 5A, 6, and the like, the guide 44 is not linearly formed but is formed to be bent at the bending guide portion 44*b* when viewed in a cross section orthogonal to the width direction.

Thus, as illustrated in FIG. 5B, when the sheet bundle PT is inserted from the insertion port 44*x* by the user, the sheet bundle PT is bent at a position of the bending guide portion 44*b* while being guided by the guide 44, and is positioned at a position where the leading end of the sheet bundle PT abuts an abutment portion 44*a*.

Figure 7A:
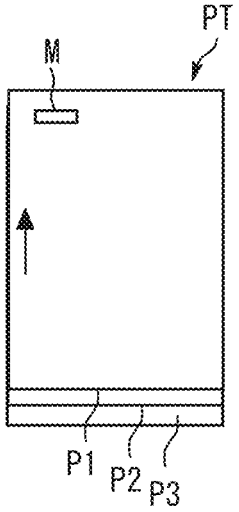
FIGS. 7A to 7F are diagrams each illustrating a sheet bundle after binding processing is performed by a manual feed processing unit.

At this time, with reference to FIG. 6, the binding processing is performed on the sheet bundle PT in a state where the bent portion PTs is formed at the position of the bending guide portion 44*b* and a sheet P2 on the lower side is shifted to the upstream side by a distance Z with respect to the a sheet P1 on the upper side. That is, as illustrated in FIG. 7A, the sheet bundle PT after the binding processing is in a state where, on the upstream side (that is the lower side of FIG. 7A and is a side where the binding processing portion M is not formed) in the manual feed direction indicated by the arrow, a plurality of stacked sheets P1, P2, and P3 is shifted to the downstream side more as the sheets P1, P2, and P3 are on the upper side.

Thus, the user easily turns the sheets P1 to P3 one by one on the side where the binding processing portion M is not formed (that is the lower side of FIG. 7A) with respect to the sheet bundle PT after being manually inserted and subjected to the binding processing.

More specifically, as illustrated in FIG. 6, assuming that a bending radius of the bent portion PTs of the sheet bundle PT bent by the bending guide portion 44*b* is r, a bending angle (incident angle) at the bending guide portion 44*b* is θ, and thicknesses of the sheets P1 and P2 constituting the sheet bundle PT are t, an amount of shift Z between the sheets P1 and P2 generated by a perimeter difference at the bent portion PTs is expressed as follows.

$$Z=2\pi r\times(\theta/360)-2\pi(r-t)\times(\theta/360)=2\pi t\times(\theta/360)$$

In a case where plain paper having a ream weight of 90 kg is used as the sheet P, assuming that the thickness of one sheet is 0.12 mm and the bending angle θ of the guide 44 is 30°, the amount of shift Z of the overlapping sheets is about 0.06 mm (an amount of shift between the first sheet and the 20th sheet in 20-sheet binding is about 1.2 mm).

If there is the amount of shift Z of about this amount, it is possible to feel that the sheet P is remarkably easily turned when the user turns only the uppermost sheet P of the sheet bundle PT with the finger as compared with a case where the amount of shift Z is 0.

When only the uppermost sheet P of the sheet bundle PT is turned, the larger the amount of shift Z is, the easier the sheet P is turned. However, in order to increase the amount of shift Z, it is necessary to increase the bending angle θ of the guide 44. When the bending angle θ is too large, it becomes difficult for the user to insert the sheet bundle PT into the insertion port 44*x*, and a large pushing force is necessary when the sheet bundle PT is caused to pass through the bending guide portion 44*b*.

Furthermore, if the amount of shift Z is made too large, the overall amount of shift Z increases as the number of bound sheets of the sheet bundle PT increases, and the appearance and balance as the sheet bundle PT deteriorate or the binding processing portion M (staple position) overlaps a portion where an image is formed.

For these reasons, the amount of shift Z is preferably set to a minimum limit (about 20° to 40°) at which the easiness of turning can be felt.

Here, with reference to FIG. 3, the guide 44 is formed with a first guide wall surface 42 as a guide wall surface with which an end surface of the sheet bundle PT can be slidably brought into contact, with the longitudinal direction of the sheet bundle PT as the manual feed direction.

That is, when inserting the gripped sheet bundle PT into the guide 44 of the manual feed processing unit 41, the user slides the sheet bundle PT along the first guide wall surface 42 extending in the manual feed direction (that is the left-right direction in FIG. 3) in a state where the end surface extending in the longitudinal direction of the sheet bundle PT is caused to abut the first guide wall surface 42. Then, a position in the manual feed processing unit 41 (guide 44) of the sheet bundle PT inserted by the user is determined in a state where the sheet bundle PT is bent by the bending guide portion 44*b*, the leading end of the sheet bundle PT abuts the abutment portion 44*a*, and the end surface extending in the lateral direction abuts a second guide wall surface 43. Then, in that state, the binding processing is performed on the corner portion of the sheet bundle PT by the staple binding device 30.

Then, as illustrated in FIG. 7A, the sheet bundle PT guided by the guide 44 along the first guide wall surface 42 with the longitudinal direction as the manual feed direction (that is the arrow direction in FIG. 7A) and subjected to the binding processing as described above is in a state where the sheets are shifted to the downstream side more as the sheets are on the upper side in the plurality of overlapping sheets P1, P2, and P3.

With reference to FIGS. 5A and 5B, the guide 44 is provided with the sheet bundle detection sensor 80 as a detector that can determine whether the sheet bundle PT is guided by the guide 44, near the bending guide portion 44*b*.

Then, when the sheet bundle detection sensor 80 (detector) detects the sheet bundle PT, assuming that manual insertion processing by the user is to be performed, preparation is started, such as movement of the staple binding device 30 to the manual feed processing unit 41, necessary display on the operation display panel 149 as a display, and the like.

As the sheet bundle detection sensor 80, it is possible to use a reflective photosensor that optically detects the presence or absence of the sheet bundle PT at the position, or the like.

Figure 8:
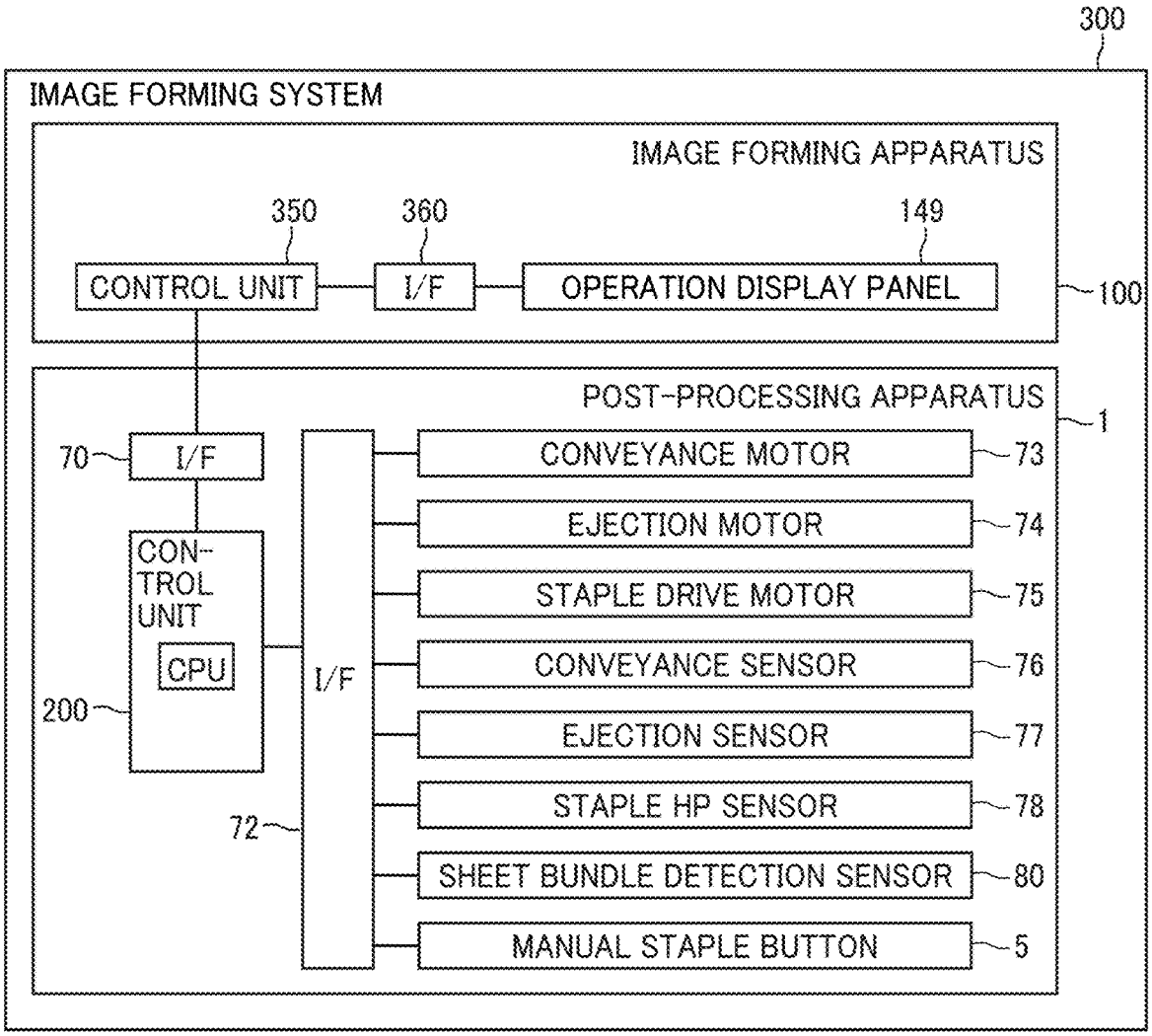
FIG. 8 is a block diagram illustrating a control system of an image forming system.

The post-processing apparatus 1 configured as described above is controlled by a control unit 200 illustrated in FIG. 8 (and FIGS. 1, 5A, 5B, and the like).

Here, as illustrated in FIG. 8, the control unit 200 of the post-processing apparatus 1 is connected to a control unit 350 of the image forming apparatus 100 via an interface 70. In addition, the control unit 350 of the image forming apparatus 100 is connected to the operation display panel 149, each of drive members, each of sensors, and the like of the image forming apparatus 100 via an interface 360. The control unit 200 of the post-processing apparatus 1 is connected to a conveyance motor 73 that rotationally drives the conveying roller pairs 11 to 13, the tapping roller 14, the return roller 16, and the like, an ejection motor 74 that rotationally drives the ejection roller pair 15, a staple drive motor 75 that drives the binding devices 30 and 40, a conveyance sensor 76 installed in the conveyance path, an ejection sensor 77 installed in an ejection port, the staple HP sensor 78 that detects a reference position of the binding device 30, a manual staple button 5, and the like via an interface 72.

Then, various operations in the image forming system 300 described above are executed by an entire control system of the image forming system 300 configured as described above.

First Modification

Figure 9:
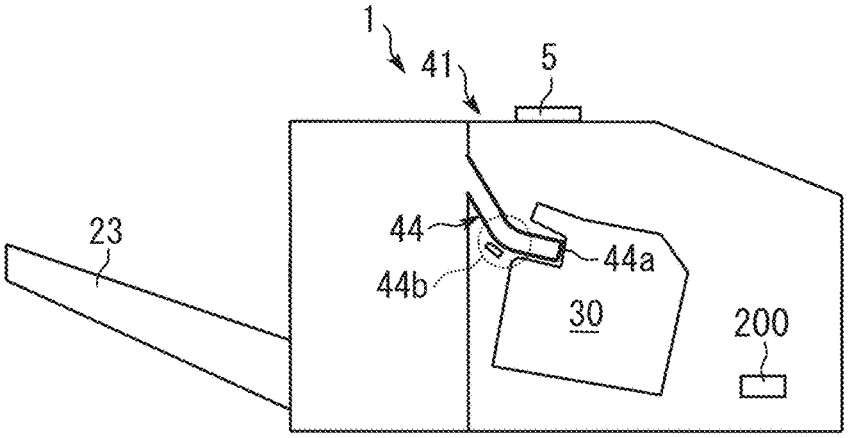
FIG. 9 is a diagram illustrating a manual feed processing unit in a post-processing apparatus according to a first modification.

As illustrated in FIG. 9, in the post-processing apparatus 1 in a first modification, the bending guide portion 44*b* of the guide 44 is not a portion where the end portions of the two planar guide portions are connected together at the predetermined angle as in the case of FIG. 5A, but is a curved portion.

That is, as illustrated in FIG. 9, the guide 44 is not linearly formed but is formed to be curved in the bending guide portion 44*b* when viewed in a cross section orthogonal to the width direction.

Thus, when the user inserts the sheet bundle PT from the insertion port 44*x*, the sheet bundle PT is curved (bent) along a curved shape of the bending guide portion 44*b* while being guided by the guide 44, and is positioned at a position where the leading end of the sheet bundle PT abuts the abutment portion 44*a*.

Even in a case where the guide 44 is formed as described above, since the binding processing is performed in a state where the leading end of the sheet bundle PT has shifts in the manual feed direction, the sheets P constituting the sheet bundle PT after the binding processing can be easily turned one by one on the side where the binding processing portion M is not formed.

Second Modification

Figure 10:
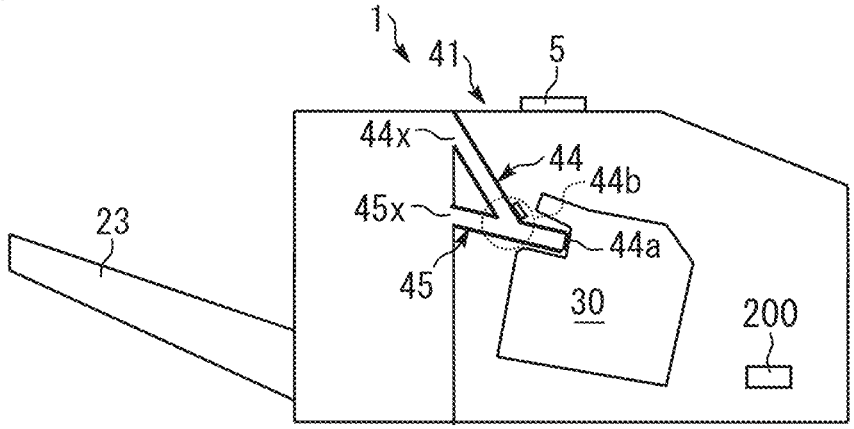
FIG. 10 is a diagram illustrating a manual feed processing unit in a post-processing apparatus according to a second modification.

As illustrated in FIG. 10, the post-processing apparatus 1 in a second modification is provided with a second guide 45 having a planar shape in addition to the guide 44 (first guide) described with reference to FIG. 5A and the like.

The post-processing apparatus 1 is configured to perform binding processing by the staple binding device 30 (binding device) on the sheet bundle PT guided by any of the guide 44 (first guide) and the second guide 45.

Specifically, as illustrated in FIG. 10, the second guide 45 is formed linearly when viewed in a cross section orthogonal to the width direction. The second guide 45 is formed so that the sheet bundle PT linearly advances in the manual feed direction from an insertion port 45*x* (that is an insertion port different from the insertion port 44*x* of the first guide 44), and linearly advances toward the abutment portion 44*a* as it is even after entering the bending guide portion 44*b* of the first guide 44. Thus, the binding processing is performed on the sheet bundle PT guided by the second guide 45 in a state where the bent portion is not formed and shifts are not generated in the leading end.

Then, in a case where the user attaches weight to turnability of the sheet of the sheet bundle PT (that is in a finally finished state) after the binding processing, the user inserts the sheet bundle PT into the insertion port 44*x* of the first guide 44 to perform the binding processing.

On the other hand, in a case where the user does not attach weight to the turnability of the sheet, the user inserts the sheet bundle PT into the insertion port 45*x* of the second guide 45 to perform the binding processing.

With this configuration, the user has more options for the binding processing.

Third Modification

Figure 11A:
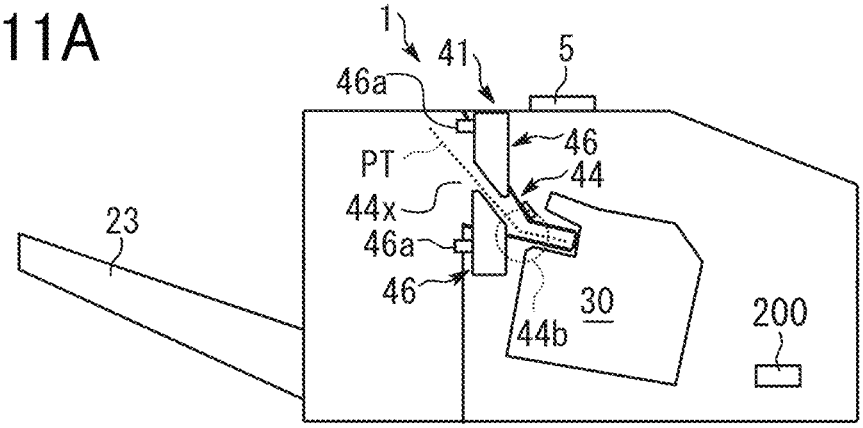
FIGS. 11A and 11B are diagrams each illustrating a manual feed processing unit in a post-processing apparatus according to a third modification.
Figure 11B:
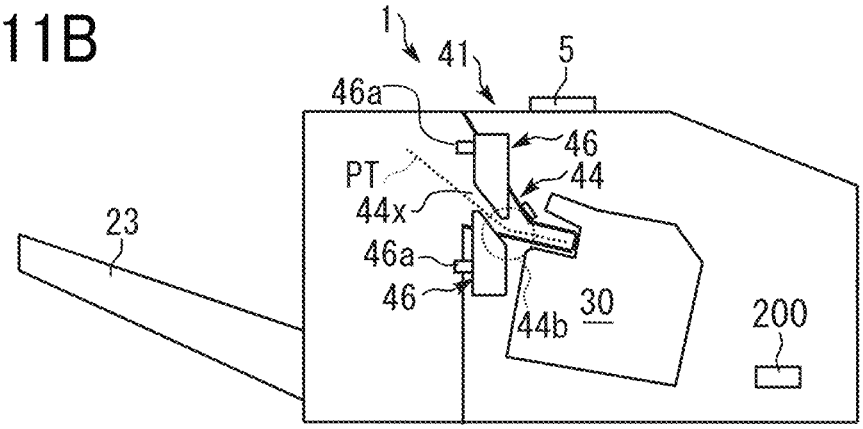

As illustrated in FIGS. 11A and 11B, in the post-processing apparatus 1 in a third modification, the guide 44 is configured to adjust a degree of bending (bending angle) of the bending guide portion 44*b*.

Specifically, the guide 44 of the manual feed processing unit 41 is formed so that an opening of the insertion port 44*x* is formed to be wide in the vertical direction, an interval in the vertical direction is narrowed from the upstream side toward the downstream side in the manual feed direction from the insertion port 44*x* to the bending guide portion 44*b*, and the interval in the vertical direction is equivalent from the bending guide portion 44*b* to the abutment portion 44*a*.

Adjustment guides 46 that allow the adjustment of an inclination from the insertion port 44*x* to the bending guide portion 44*b* (that is, the degree of bending in the bending guide portion 44*b*) are provided in a path from the insertion port 44*x* to the bending guide portion 44*b*.

In the path from the insertion port 44*x* to the bending guide portion 44*b*, the adjustment guides 46 are installed at an interval (that is substantially equal to the interval in the vertical direction in a path from the bending guide portion 44*b* to the abutment portion 44*a*) in the vertical direction so as to sandwich the inserted sheet bundle PT. The upper and lower adjustment guides 46 are configured to move up and down in a pair by manual operation of an adjustment lever 46*a* so that the bending angle of the bending guide portion 44*b* changes.

Specifically, as illustrated in FIG. 11A, when the adjustment guides 46 move upward, the bending angle θ of the bending guide portion 44*b* increases, and as illustrated in FIG. 11B, when the adjustment guides 46 move downward, the bending angle θ of the bending guide portion 44*b* decreases (approaches a straight line).

With such a configuration, it is possible to adjust the turnability of the sheet of the sheet bundle PT (that is in a finally finished state) after the binding processing, and thus, the user has more options for the binding processing.

Fourth Modification

Figure 12:
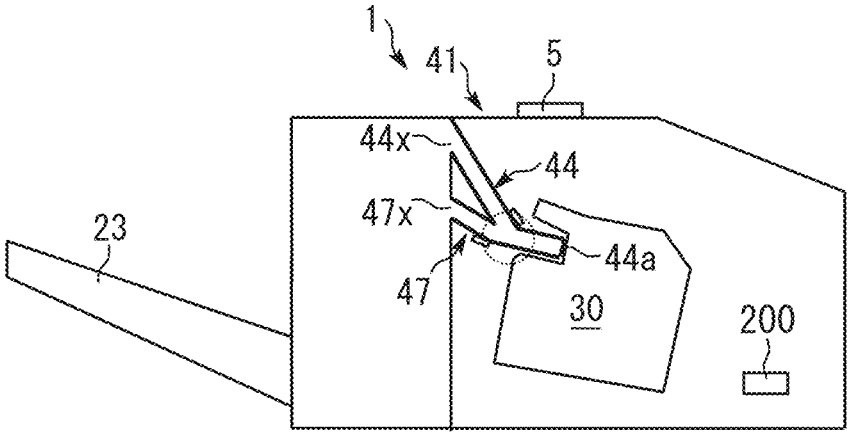
FIG. 12 is a diagram illustrating a manual feed processing unit in a post-processing apparatus according to a fourth modification.

As illustrated in FIG. 12, the post-processing apparatus 1 in a fourth modification is provided with a guide 47 (second guide) having a different degree of bending (bending angle θ) in the bending guide portion, in addition to the guide 44 (first guide) described with reference to FIG. 5A and the like.

That is, a plurality of guides (that is two guides 44 and 47 in the present embodiment) having different degrees of bending in the bending guide portion is provided.

The post-processing apparatus 1 is configured to perform binding processing by the staple binding device 30 (binding device) on the sheet bundle PT guided by any one of the plurality of guides 44 and 47.

Specifically, the second guide 47 is formed such that the bending angle θ of the bending guide portion is smaller (is closer to a straight line) than the bending angle θ of the bending guide portion of the first guide 44. For that reason, in a case where the sheet bundle PT is inserted into the second guide 47 to perform the binding processing, as compared with a case where the sheet bundle PT is inserted into the first guide 44 to perform the binding processing, the amount of shift Z of the sheets of the sheet bundle PT (that is in a finally finished state) after the binding processing is reduced, and the turnability of the sheet P is deteriorated.

Then, in a case where the user attaches weight to the turnability of the sheets of the sheet bundle PT (that is in a finally finished state) after the binding processing, the user inserts the sheet bundle PT into the insertion port 44*x* of the first guide 44 to perform the binding processing.

On the other hand, in a case where the user attaches weight more to appearance than such turnability of the sheet, the user inserts the sheet bundle PT into the insertion port 47*x* of the second guide 47 to perform the binding processing.

With this configuration, the user has more options for the binding processing.

Fifth Modification

Figure 13:
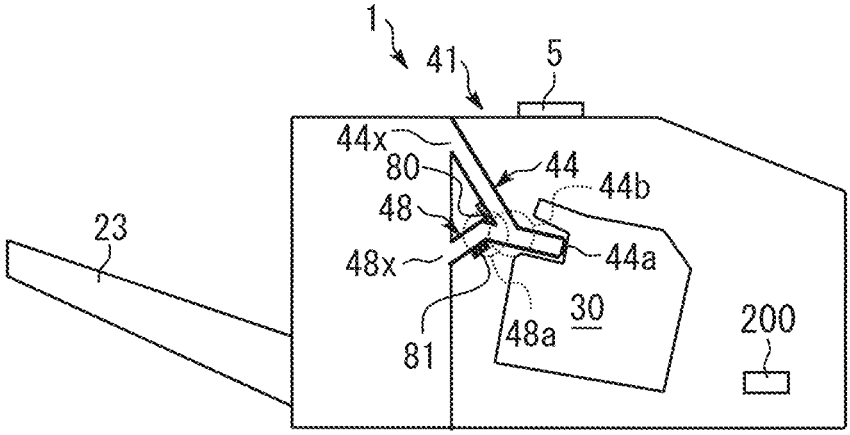
FIG. 13 is a diagram illustrating a manual feed processing unit in a post-processing apparatus according to a fifth modification.

As illustrated in FIG. 13, the post-processing apparatus 1 in a fifth modification is provided with a guide 48 (second guide) having a different direction of bending in the bending guide portion in addition to the guide 44 (first guide) described with reference to FIG. 5A and the like.

That is, a plurality of guides (that is two guides 44 and 48 in the present embodiment) having different directions of bending in the bending guide portion is provided.

The post-processing apparatus 1 is configured to perform binding processing by the staple binding device 30 (binding device) on the sheet bundle PT guided by any guide among the plurality of guides 44 and 48.

Specifically, the second guide 48 is formed such that a direction of bending in a bending guide portion 48*a* is reversed to a direction of bending of the first guide 44 (a path from the insertion port 48*x* to the bending guide portion 48*a* is inclined from the lower side to the upper side along the manual feed direction). For that reason, in a case where the sheet bundle PT is inserted into the second guide 48 to perform the binding processing, a shift direction of the sheets of the sheet bundle PT (that is in a finally finished state) after the binding processing is reversed with respect to the case where the sheet bundle PT is inserted into the first guide 44 to perform the binding processing.

Specifically, in the case where the sheet bundle PT is inserted into the first guide 44 to perform the binding processing, the finished sheet bundle PT is as illustrated in FIG. 7A.

Figure 7B:
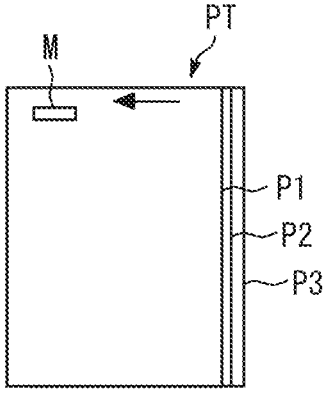
Figure 7C:
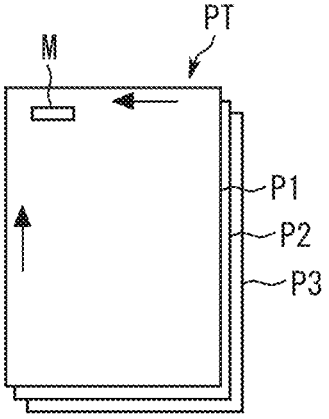
Figure 7D:
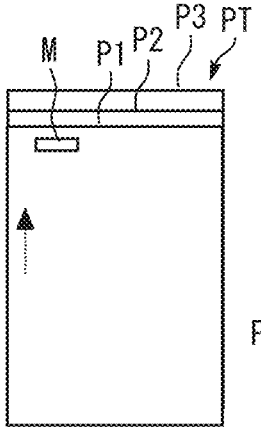

On the other hand, in the case where the sheet bundle PT is inserted into the second guide 48 to perform the binding processing, the finished sheet bundle PT is as illustrated in FIG. 7D. That is, in the case where the sheet bundle PT is inserted into the second guide 48 to perform the binding processing, the finished sheet bundle PT is in a state where, on the downstream side (that is an upper side of FIG. 7D and is a side where the binding processing portion M is formed) in the manual feed direction indicated by the arrow, the plurality of stacked sheets P1, P2, and P3 is shifted to the upstream side more as the sheets P1, P2, and P3 are on the upper side. Even in such a case, the sheets P constituting the sheet bundle PT after the binding processing are easily turned one by one on the side where the binding processing portion M is not formed (that is the lower side of FIG. 7D).

Then, in a case where the user desires to set the state of the sheet bundle PT after the binding processing to the state as illustrated in FIG. 7A, the user inserts the sheet bundle PT into the insertion port 44*x* of the first guide 44 to perform the binding processing. On the other hand, in a case where the user desires to set the state of the sheet bundle PT after the binding processing to the state as illustrated in FIG. 7D, the user inserts the sheet bundle PT into the insertion port 48*x* of the second guide 48 to perform the binding processing.

With this configuration, the user has more options for the binding processing.

Here, as illustrated in FIG. 13, in the fifth modification, a first sheet bundle detection sensor 80 is installed, as a detector that can determine whether the sheet bundle PT has been guided by the first guide 44, in the first guide 44. In the second guide 48, a second sheet bundle detection sensor 81 is installed as a detector that can determine whether the sheet bundle PT is guided by the second guide 48.

Figure 14:
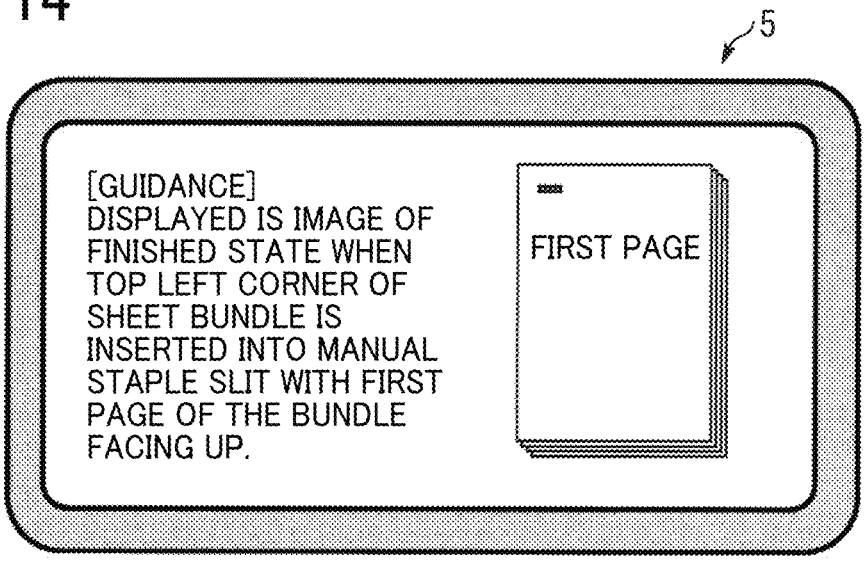
FIG. 14 is a diagram illustrating a screen display on an operation display panel.

Then, the operation display panel 149 installed in the image forming apparatus 100 functions as a display that, before binding processing, displays an image of a finished state of the sheet bundle PT in a case where the binding processing by the staple binding device 30 (binding device) is completed (see FIG. 14), on the basis of results of detection by the sheet bundle detection sensors 80 and 81 (detectors).

Specifically, when the state where the sheet bundle PT is inserted into the first guide 44 is detected by the first sheet bundle detection sensor 80, a display indicating that the finished state of the sheet bundle PT is as illustrated in FIG. 7A is displayed on the operation display panel 149. On the other hand, when the state where the sheet bundle PT is inserted into the second guide 48 is detected by the second sheet bundle detection sensor 81, a display indicating that the finished state of the sheet bundle PT is as illustrated in FIG. 7D is displayed on the operation display panel 149.

Figure 15:
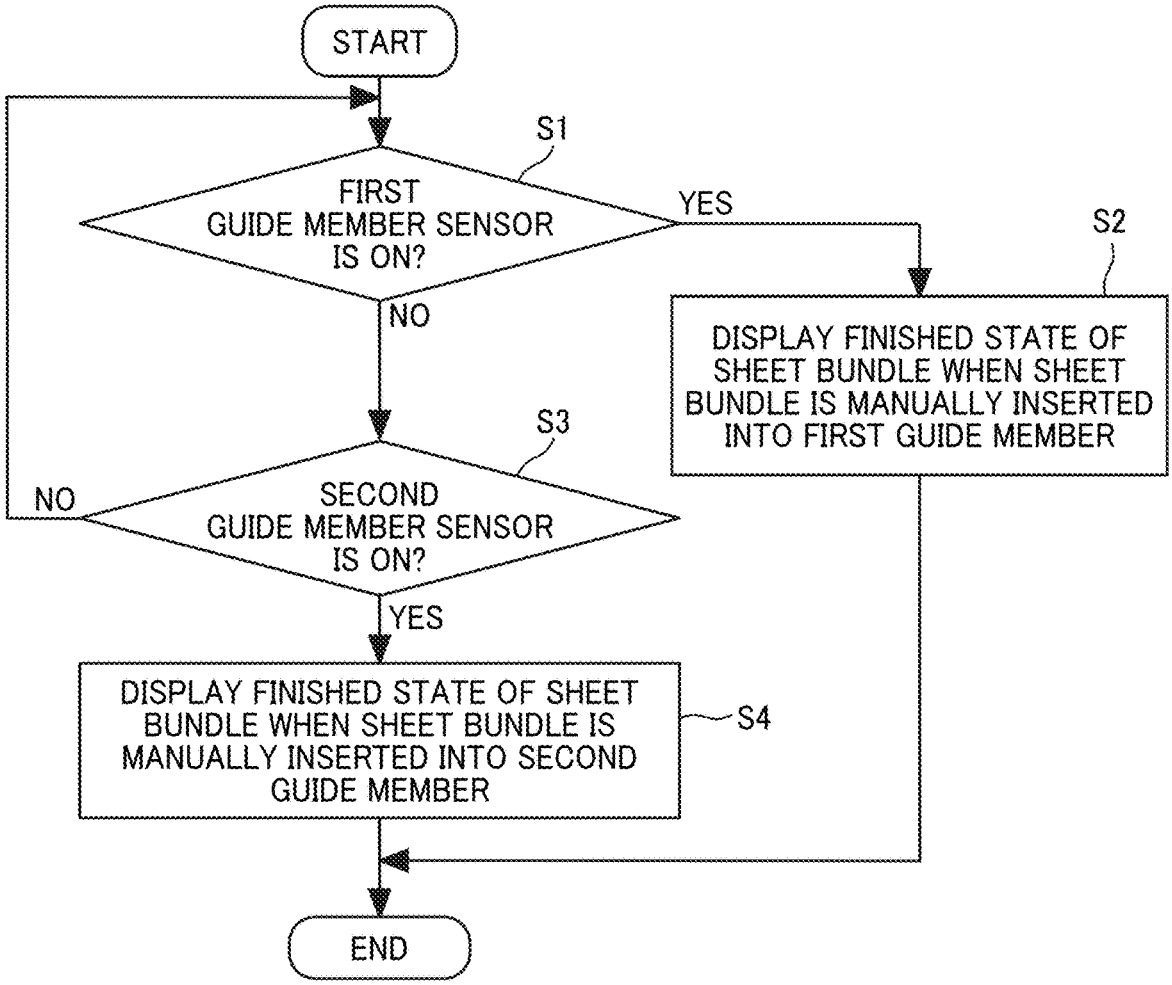
FIG. 15 is a flowchart illustrating control performed by the post-processing apparatus of FIG. 13.

More specifically, as in a control flow illustrated in FIG. 15, first, it is determined whether a signal of the first sheet bundle detection sensor 80 of the first guide 44 located at the upper portion is ON (step S1), and in a case where the signal is ON, the display indicating that the finished state of the sheet bundle PT is as illustrated in FIG. 7A is displayed on the operation display panel 149 (step S2). On the other hand, in a case where the signal of the first sheet bundle detection sensor 80 is OFF in step S1, it is determined whether a signal of the second sheet bundle detection sensor 81 of the second guide 48 located at the lower portion is ON (step S3), and in a case where the signal is ON, the display indicating that the finished state of the sheet bundle PT is as illustrated in FIG. 7D is displayed on the operation display panel 149. (step S4).

Such control is performed, whereby the user's usability for the binding processing is improved.

Sixth Modification

Figure 16A:
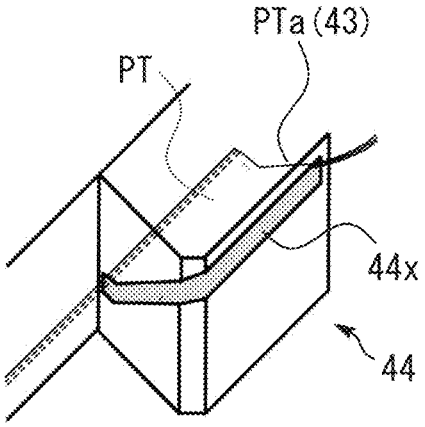
FIGS. 16A and 16B are perspective views each illustrating a part of a manual feed processing unit in a post-processing apparatus according to a sixth modification.

As illustrated in FIG. 16A, in the post-processing apparatus 1 in a sixth modification, the guide 44 is formed with a guide wall surface 43 (that is a wall surface in which the second guide wall surface 43 illustrated in FIG. 3 is extended in the vertical direction of FIG. 3) on which an end surface (lateral direction side end surface PTa) of the sheet bundle PT is slidable, with the lateral direction of the sheet bundle PT as the manual feed direction.

That is, when inserting the gripped sheet bundle PT into the guide 44 of the manual feed processing unit 41, the user slides the sheet bundle PT along the second guide wall surface 43 extending in the manual feed direction (that is the vertical direction of FIG. 3) in a state where the lateral direction side end surface PTa extending in the lateral direction of the sheet bundle PT is caused to abut the second guide wall surface 43. Then, a position in the manual feed processing unit 41 (guide 44) of the sheet bundle PT inserted by the user is determined in a state where the sheet bundle PT is bent by the bending guide portion 44*b*, the leading end of the sheet bundle PT abuts the abutment portion 44*a*, and the end surface extending in the longitudinal direction abuts the first guide wall surface 42. Then, in that state, the binding processing is performed on the corner portion of the sheet bundle PT by the staple binding device 30.

Then, as illustrated in FIG. 7B, the sheet bundle PT guided by the guide 44 along the second guide wall surface 43 with the lateral direction as the manual feed direction (that is the arrow direction in FIG. 7B) and subjected to the binding processing as described above is in a state where, the plurality of overlapping sheets P1, P2, and P3 is shifted to the downstream side more as the sheets P1, P2, and P3 are on the upper side.

Figure 7E:
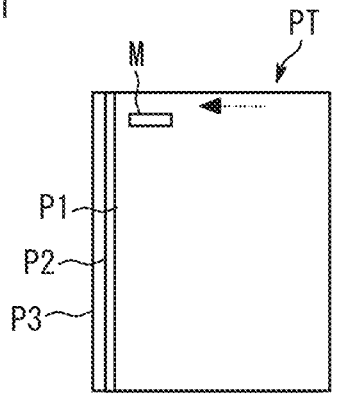

Note that, in a case where the sheet bundle PT is inserted into the second guide 48 described with reference to FIG. 13 with the lateral direction of the sheet bundle PT as the manual feed direction as described above and bent by the bending guide portion 48*a*, as illustrated in FIG. 7E, the sheet bundle PT after the binding processing is in a state where the plurality of overlapping sheets P1, P2, and P3 is shifted to the upstream side more as the sheets P1, P2, and P3 are on the upper side.

In any case, since the binding processing is performed in a state where the leading end of the sheet bundle PT has shifts in the manual feed direction, the sheets P constituting the sheet bundle PT after the binding processing can be easily turned one by one on the side where the binding processing portion M is not formed.

Figure 16B:
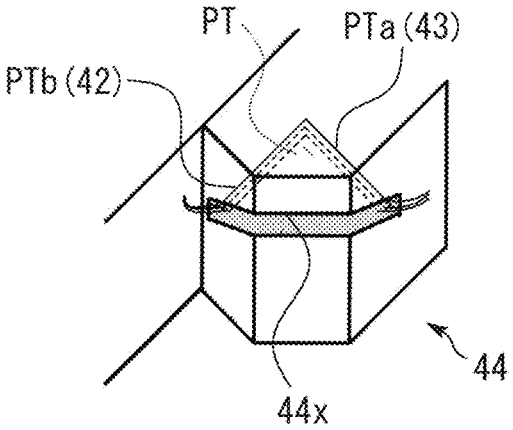

On the other hand, as illustrated in FIG. 16B, the guide 44 can also be formed with the first guide wall surface 42 on which an end surface (longitudinal direction side end surface PTb) of the sheet bundle PT is slidable, with the longitudinal direction of the sheet bundle PT as the manual feed direction, and the second guide wall surface 43 in which the end surface (lateral direction side end surface PTa) of the sheet bundle PT is slidable, with the lateral direction of the sheet bundle PT as the manual feed direction.

That is, when inserting the gripped sheet bundle PT into the guide 44 of the manual feed processing unit 41, the user slides the sheet bundle PT along the first guide wall surface 42 and the second guide wall surface 43 in a state where the longitudinal direction side end surface PTb extending in the longitudinal direction of the sheet bundle PT is caused to abut the first guide wall surface 42, and the lateral direction side end surface PTa extending in the lateral direction of the sheet bundle PT is caused to abut the second guide wall surface 43. Then, a position in the manual feed processing unit 41 (guide 44) of the sheet bundle PT inserted by the user is determined in a state where the sheet bundle PT is bent by the bending guide portion 44*b*, the leading end of the sheet bundle PT abuts the abutment portion 44*a*, and the end surfaces PTa and PTb abut the first guide wall surface 42 and the second guide wall surface 43. Then, in that state, the binding processing is performed on the corner portion of the sheet bundle PT by the staple binding device 30.

Then, as illustrated in FIG. 7C, the sheet bundle PT guided by the guide 44 along the first guide wall surface 42 and the second guide wall surface 43 with the longitudinal direction and the lateral direction as manual feed directions (that are the arrow directions in FIG. 7C) as described above and subjected to the binding processing is in a state where the plurality of overlapping sheets P1, P2, and P3 is shifted to downstream side two directions (downstream side oblique direction) more as the sheets P1, P2, and P3 are on the upper side.

Figure 7F:
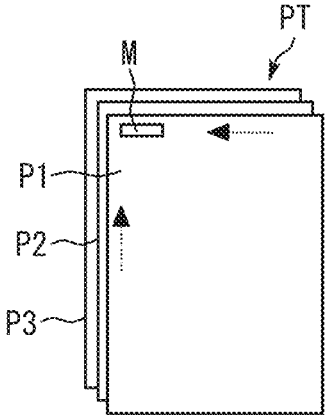

Note that, in a case where the sheet bundle PT is inserted into the second guide 48 described with reference to FIG. 13 with the longitudinal direction and the lateral direction of the sheet bundle PT as the manual feed directions as described above and bent by the bending guide portion 48*a*, as illustrated in FIG. 7F, the sheet bundle PT after the binding processing is in a state where the plurality of overlapping sheets P1, P2, and P3 is shifted to upstream side two directions (upstream side oblique direction) more as the sheets P1, P2, and P3 are on the upper side.

In any case, since the binding processing is performed in a state where the leading end of the sheet bundle PT has shifts in the manual feed direction, the sheets P constituting the sheet bundle PT after the binding processing can be easily turned one by one on the side where the binding processing portion M is not formed.

Seventh Modification

Figure 17:
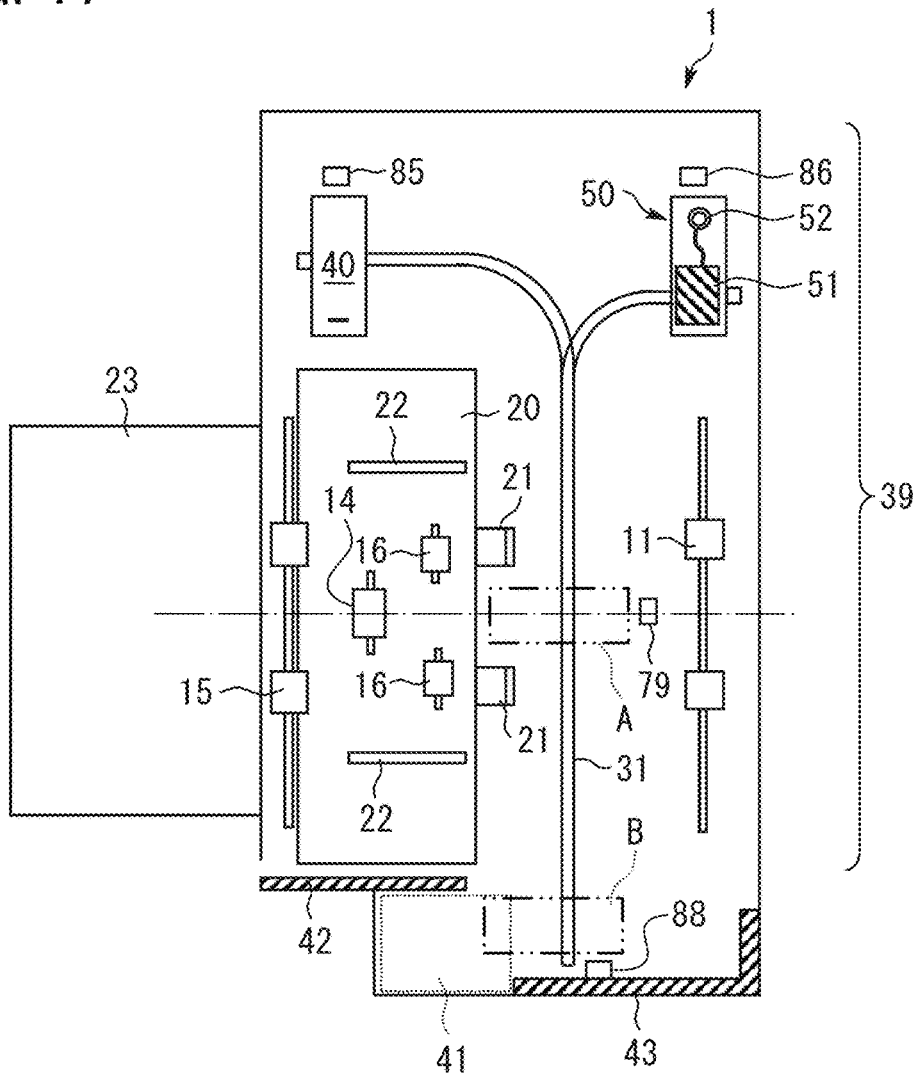
FIG. 17 is a top view of a post-processing apparatus according to a seventh modification.

As illustrated in FIG. 17, the post-processing apparatus 1 in a seventh modification is configured so that the stapleless binding device 40 as a binding device is used in both the binding processing performed by the automatic processing device 39 and the binding processing in the manual feed processing unit 41.

Figure 18A:
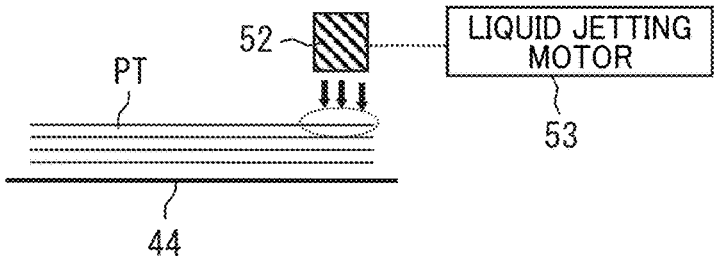
FIGS. 18A and 18B are diagrams each illustrating a state in which liquid is jetted to a sheet bundle by a liquid jetting unit.

In addition, as illustrated in FIGS. 17 and 18A, the post-processing apparatus 1 in the seventh modification is provided with a liquid jetting unit 50 as a liquid impregnator that impregnates the leading end of the sheet bundle PT (that is a portion where the binding processing portion M is to be formed) with liquid such as water before the binding processing is performed on the sheet bundle PT by the stapleless binding device 40 (binding device).

The liquid jetting unit 50 (liquid impregnator) includes a liquid storage tank 51, a liquid jetting nozzle 52, a liquid jetting motor 53, and the like. The liquid storage tank 51 stores liquid such as water. The liquid jetting nozzle 52 is connected to the liquid storage tank 51 via a tube. Then, the liquid jetting motor 53 is driven, whereby the liquid stored in the liquid storage tank 51 is jetted from the liquid jetting nozzle 52, the liquid is supplied from above to the leading end of the sheet bundle PT, and the leading end is impregnated with the liquid. A process of impregnating the leading end of the sheet bundle PT with the liquid in this manner is performed before the stapleless binding processing by the stapleless binding device 40 is performed. The process is performed, whereby a degree of entanglement of the unevenness between the sheets P is increased, and binding processability by the stapleless binding device 40 is improved.

Figure 18B:
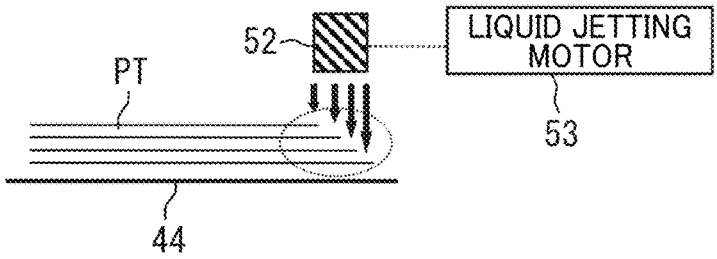

In particular, in a case where the sheet bundle PT is inserted obliquely upward from the insertion port 48*x* as in the second guide 48 as a guide in the manual feed processing unit 41 to form the sheet bundle PT as illustrated in FIG. 7D as described above with reference to FIG. 13, as illustrated in FIG. 18B, the sheet P on the upper side is shifted to the upstream side (that is the left side in FIG. 18B) at the leading end of the sheet bundle PT. For that reason, the liquid is directly jetted from the liquid jetting nozzle 52 to the leading end of each sheet of the sheets P from the upper side to the lower side, the impregnation of the entire sheet bundle PT is increased, and the binding processability is further improved.

As illustrated in FIG. 17, in the post-processing apparatus 1 in the seventh modification, the stapleless binding device 40 (binding device) and the liquid jetting unit (liquid impregnator) are configured to be separately movable between the manual feed processing unit 41 and the automatic processing device 39.

Specifically, each of the stapleless binding device 40 and the liquid jetting unit 50 is configured to be moved, by a moving mechanism, along the guide rail 31, from a reference position (detected by detection sensors 85 and 86) illustrated in FIG. 17 to a processing position A (detected by a detection sensor 79) in the automatic processing device 39 at the time of the automatic binding processing, and to a processing position B (detected by a detection sensor 88) in the manual feed processing unit 41 at the time of the manual binding processing. Then, after the liquid jetting by the liquid jetting unit 50 is performed on the sheet bundle PT while adjusting a movement timing so that the stapleless binding device 40 and the liquid jetting unit 50 do not interfere with each other at each of the processing positions A and B, the binding processing by the stapleless binding device 40 is performed.

Also in the seventh modification, since the bending guide portion 44*b* is provided in the guide 44 in the manual feed processing unit 41, the binding processing is performed in a state where the leading end of the sheet bundle PT has shifts in the manual feed direction, and the sheets P constituting the sheet bundle PT after the binding processing can be easily turned one by one on the side where the binding processing portion M is not formed.

In the seventh modification, the liquid jetting unit 50 (liquid impregnator) can be configured to be detachable from the post-processing apparatus 1. In such a case, by detachably installing the staple binding device 30 (see FIG. 3 and the like) instead of the liquid jetting unit 50, it is possible to expand options for the binding processing for the user.

Eighth Modification

Figure 19:
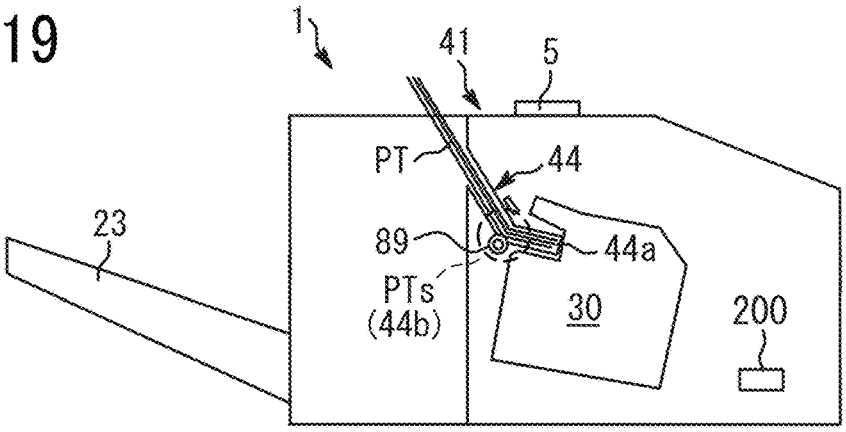
FIG. 19 is a diagram illustrating a manual feed processing unit in a post-processing apparatus according to an eighth modification.

As illustrated in FIG. 19, in the post-processing apparatus 1 in an eighth modification, the guide 44 is provided with a roller 89 (or a roller member) that facilitates movement of the sheet bundle PT in the bending guide portion 44*b*.

Specifically, the roller 89 is provided below the bending guide portion 44*b* so as to come into contact with the sheet bundle PT. The roller 89 is provided because sliding resistance of the sheet bundle PT inserted into the guide 44 is maximized when the sheet bundle PT reaches the bending guide portion 44*b*. That is, when the sheet bundle PT inserted into the guide 44 reaches the bending guide portion 44*b*, the sliding resistance with the bending guide portion 44*b* is reduced by the roller 89 rotating along the manual feed direction, and the sheet bundle PT smoothly moves toward the abutment portion 44*a*.

Also in the eighth modification, since the binding processing is performed in a state where the leading end of the sheet bundle PT has shifts in the manual feed direction, the sheets P constituting the sheet bundle PT after the binding processing can be easily turned one by one on the side where the binding processing portion M is not formed.

Ninth Modification

Figure 20:
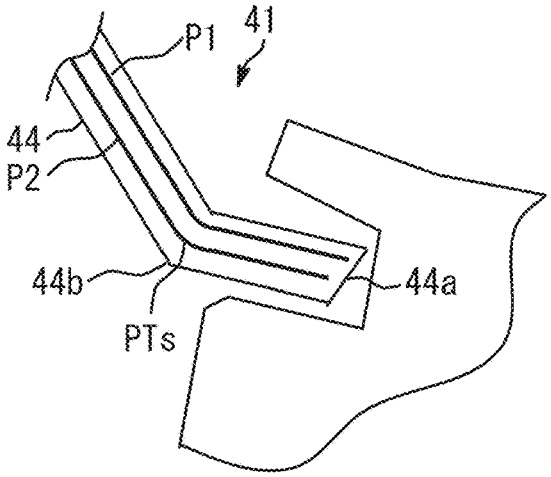
FIG. 20 is a diagram illustrating a part of a manual feed processing unit in a post-processing apparatus according to a ninth modification.

As illustrated in FIG. 20, in the post-processing apparatus 1 in a ninth modification, the abutment portion 44*a* of the guide 44 is formed so as to be inclined with respect to a stacking direction in which sheets P are stacked in the sheet bundle PT.

Specifically, the abutment portion 44*a* is not formed so as to stand vertically with respect to the manual feed direction, but is inclined and stands along a shift (inclination) generated in the sheets P overlapping at the leading end of the sheet bundle PT.

With such a configuration, the binding processing is stably performed in a state where a posture of the leading end of the sheet bundle PT (that is the leading end in a state where the amount of shift Z is generated) is further determined.

Thus, also in the ninth modification, the binding processing is performed in a state where the leading end of the sheet bundle PT has shifts in the manual feed direction, and the sheets P constituting the sheet bundle PT after the binding processing can be easily turned one by one on the side where the binding processing portion M is not formed.

Tenth Modification

Figure 21:
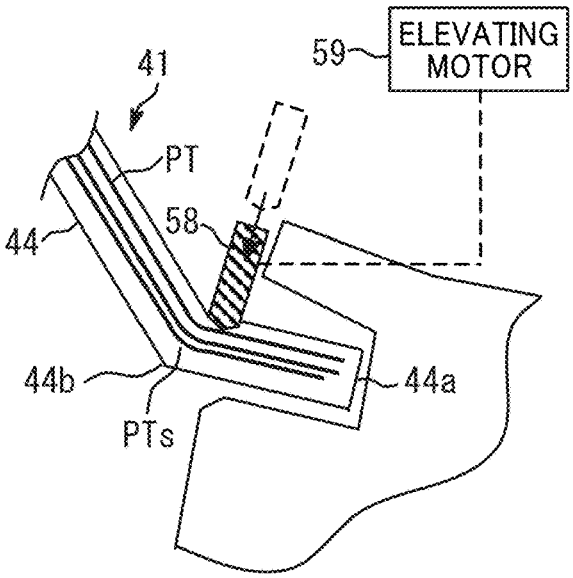
FIG. 21 is a diagram illustrating a part of a manual feed processing unit in a post-processing apparatus according to a tenth modification.

As illustrated in FIG. 21, in the post-processing apparatus 1 in a tenth modification, the manual feed processing unit 41 is provided with a pressing member 58 that can be lifted and lowered to press the sheet bundle PT on which the binding processing by the binding device 30 is performed in a stacking direction (that is a direction in which the sheets P are stacked in the sheet bundle PT).

Specifically, the pressing member 58 descends from a standby position indicated by a broken line to a position where the upper surface near the leading end of the sheet bundle PT in the state of abutting the abutment portion 44*a* in the guide 44 (that is a position on the upstream side of the portion where the binding processing portion M is to be formed) is pressed downward by driving of an elevating motor 59 (elevating mechanism). Then, the binding processing by the binding device 30 is performed in a state where the sheet bundle PT is pressed by the pressing member 58 lowered as described above so as not to float upward. For that reason, a problem is reduced that the sheet bundle PT is shifted and accuracy of the binding processing is lowered at the time of the binding processing by the binding device 30.

In particular, in the sheet bundle PT inserted into the guide 44 of the manual feed processing unit 41, the bent portion PTs is formed, and the sheet P easily floats upward due to repulsion of the portion, so that the configuration of the tenth modification is useful.

Figure 22:
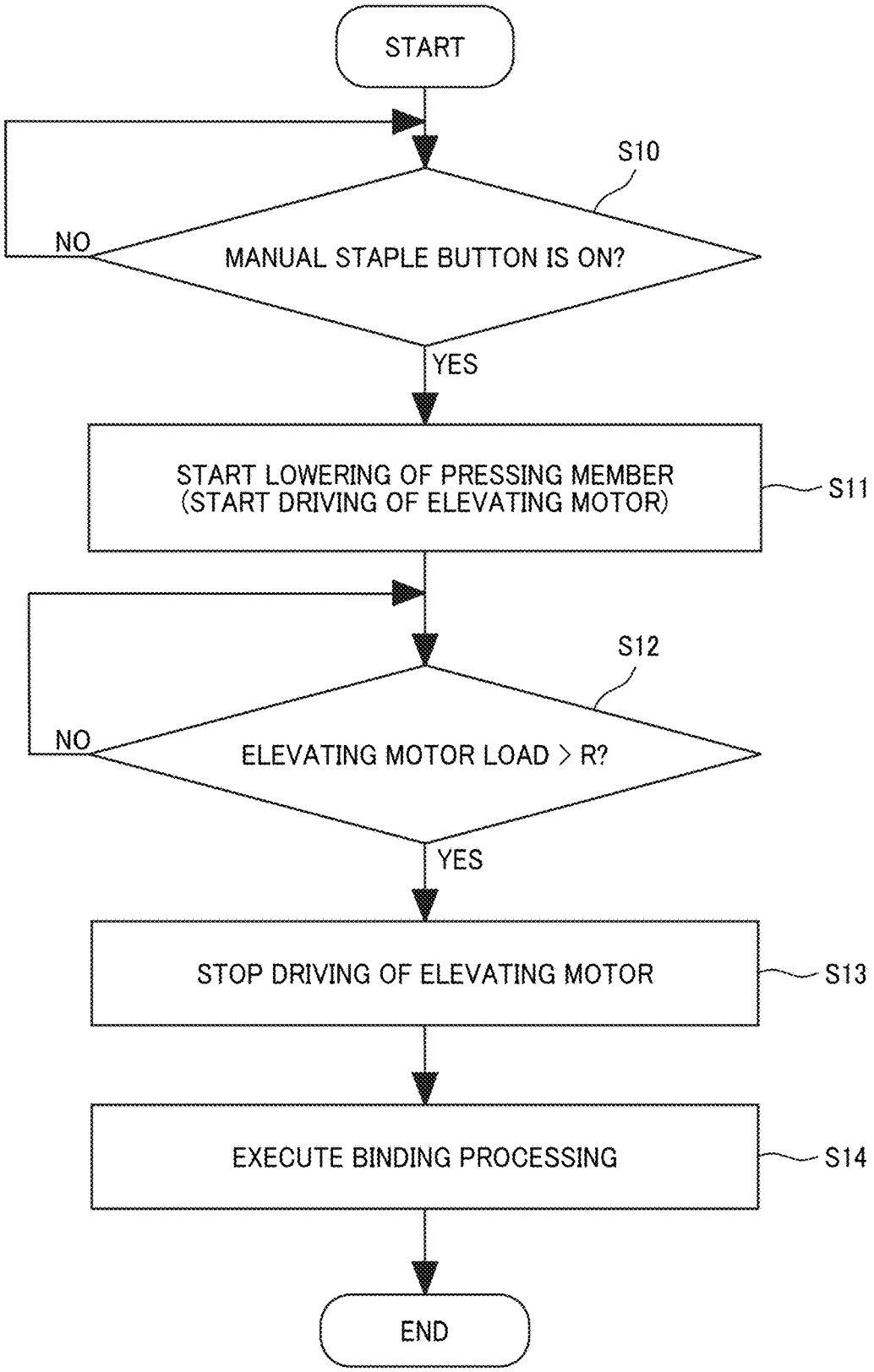
FIG. 22 is a flowchart illustrating control performed by the post-processing apparatus of FIG. 21.

FIG. 22 is a flowchart illustrating an example of control performed by the post-processing apparatus 1 of the tenth modification.

First, when the user sets the sheet bundle PT in the manual feed processing unit 41 and presses the manual staple button 5 (step S10), the elevating motor 59 starts to be driven so that the pressing member 58 is lowered from the standby position (step S11). When a load of the elevating motor 59 (detected by a motor current value or the like) reaches a predetermined value R, lowering of the pressing member 58 is stopped by stopping driving of the elevating motor 59 (steps S12 and S13). The predetermined value R is a value determined by the magnitude of reaction force received by the pressing member 58 when the pressing member 58 presses the sheet bundle PT with an optimum force. Then, in a state where the sheet bundle PT is pressed by the pressing member 58 with the optimum force in this manner, the binding processing by the binding device 30 is executed (step S14).

Eleventh Modification

Figure 23:
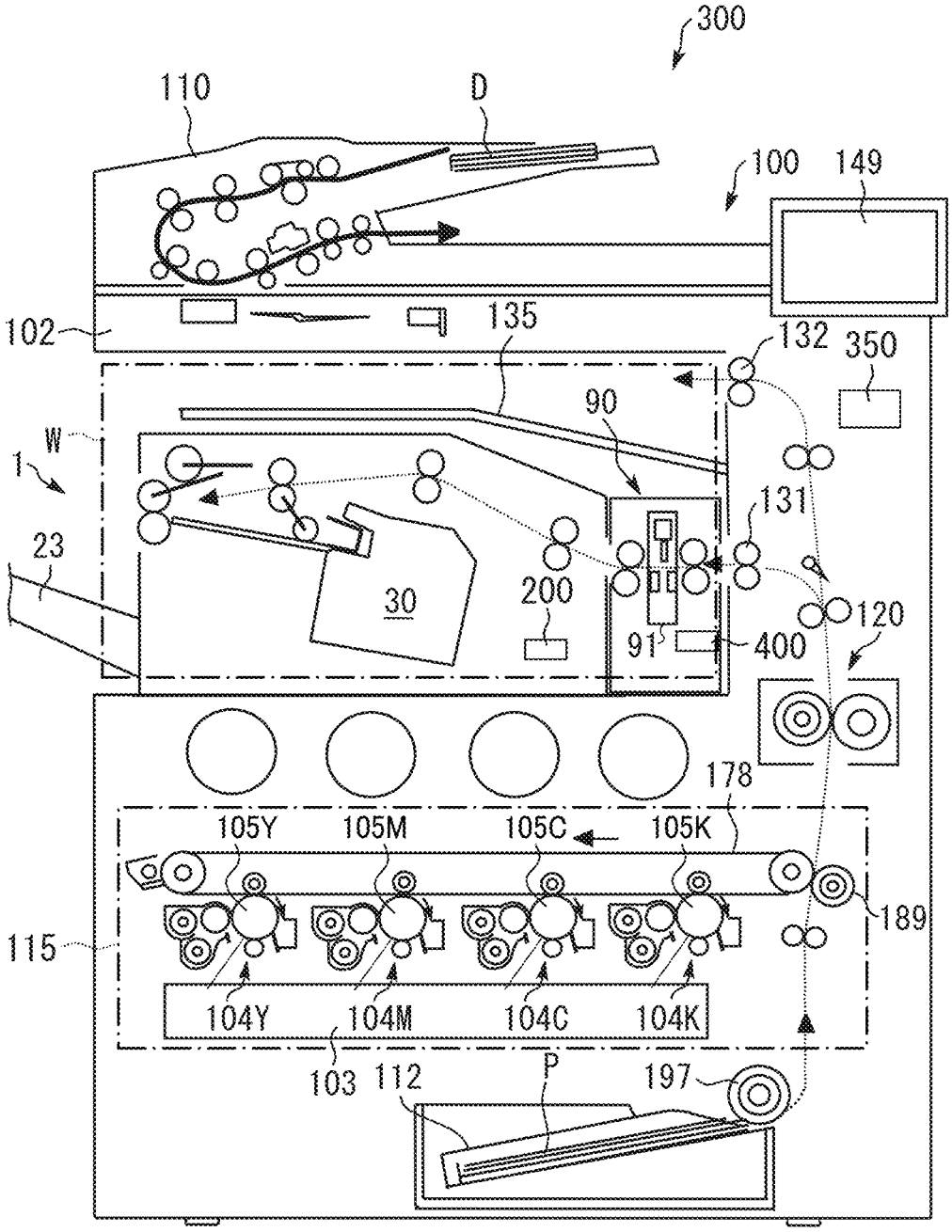
FIG. 23 is a diagram illustrating the overall configuration of an image forming system according to an eleventh modification.

As illustrated in FIG. 23, in the image forming system 300 in an eleventh modification, a punching device 90 as a second post-processing apparatus (optional device) is installed in the in-body space W in the image forming apparatus 100 on the upstream side (upstream side in a sheet conveyance direction) of the post-processing apparatus 1 (first post-processing apparatus).

The punching device 90 is provided with a punch unit 91 therein, and performs punching processing (punch processing) on the sheet P inserted from the image forming apparatus 100 in a case where the user selects a punching mode.

The punching device 90 is configured to convey the sheet P ejected from the image forming apparatus 100 toward the post-processing apparatus 1 regardless of the presence or absence of the punching processing.

Also in the eleventh modification, the post-processing apparatus 1 is configured and operates similarly to the post-processing apparatus described with reference to FIGS. 2 to 6 and the like.

Also in the image forming system 300 configured as described above, the post-processing apparatus 1 is relatively reduced in size and cost.

In the eleventh modification, the punching device 90 that can execute the punching processing is installed as the second post-processing apparatus, but it is possible to install a device that can execute other processing (that is processing by the liquid jetting unit 50 (liquid impregnator) described in the seventh modification, for example) as the second post-processing apparatus.

In the eleventh modification, the second post-processing apparatus (the punching device 90) is disposed on the upstream side of the first post-processing apparatus (the post-processing apparatus 1), but the second post-processing apparatus (the punching device 90) can also be disposed on the downstream side of the first post-processing apparatus (the post-processing apparatus 1).

As described above, the post-processing apparatus 1 in the present embodiment is provided with the manual feed processing unit 41 to which the sheet bundle PT formed by stacking the plurality of sheets P is manually fed, and the binding device 30 that performs the binding processing on the leading end on the downstream side in the manual feed direction of the sheet bundle PT in the state of being manually fed into the manual feed processing unit 41. The manual feed processing unit 41 is provided with the guide 44 including the bending guide portion 44*b* that bends a portion on the upstream side in the manual feed direction from the leading end as the bent portion PTs while guiding the sheet bundle PT when the sheet bundle PT is manually fed.

As a result, the sheets P constituting the sheet bundle PT after being manually inserted and subjected to the binding processing can be easily turned one by one.

In the present embodiment, the image forming system 300 includes the image forming apparatus 100 for color images, but in other embodiments, an image forming system may include an image forming apparatus for monochrome images. In addition, in the present embodiment, the image forming system 300 includes the image forming apparatus 100 of an electrophotographic system. However, embodiments of the present disclosure are not limited to this, and, for example, an image forming system may include an image forming apparatus of another system such as an image forming apparatus of an inkjet system or a stencil printer.

In the present embodiment, the post-processing apparatus 1 is connected to the image forming apparatus 100, but in other embodiments, a stand-alone post-processing apparatus may not be connected to the image forming apparatus.

In the present embodiment, the binding device 30 is configured to be movable, and the binding device 30 can be shared by the automatic processing device 39 and the manual feed processing unit 41. However, dedicated binding devices can be installed in the automatic processing device and the manual feed processing unit, respectively.

Even in such a case, an advantageous effect equivalent to the effect of the present embodiment can be obtained.

Note that the present invention is not limited to the above-described embodiments and it is apparent that the above-described embodiments can be appropriately modified within the scope of the technical idea of the present invention in addition to what is suggested in the above-described embodiments. Further, the number, position, shape, and so forth of the constituent members are not limited to the above-described embodiments, and may be the number, position, shape, and so forth that are suitable for implementing the present invention.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A post-processing apparatus, comprising:

a manual feed processing unit into which a sheet bundle including a plurality of sheets stacked is manually fed; and a binder to bind a leading end of the sheet bundle downstream in a manual feed direction of the sheet bundle in a state where the sheet bundle is manually fed into the manual feed processing unit, the manual feed processing unit including a guide that includes a bending guide portion to bend a portion upstream from the leading end of the sheet bundle in the manual feed direction.

2. The post-processing apparatus according to claim 1, wherein the guide is formed to sandwich the sheet bundle from a front surface side and a back surface side of the sheet bundle.

3. The post-processing apparatus according to claim 1, wherein the bending guide portion is a portion where ends of two planar guide portions are connected to each other at a predetermined angle, or a curved portion.

4. The post-processing apparatus according to claim 1, wherein the guide is adjustable in degree of bending at the bending guide portion.

5. The post-processing apparatus according to claim 1, further comprising a plurality of guides including the guide, the plurality of guides being different from each other in degree or direction of bending at the bending guide portion, wherein the binder is to bind a sheet bundle guided by any one of the plurality of guides.

6. The post-processing apparatus according to claim 1, further comprising another guide having a planar shape, wherein the binder is to bind a sheet bundle guided by any one of the guide and said another guide.

7. The post-processing apparatus according to claim 1, wherein the guide includes a roller to facilitate movement of the sheet bundle at the bending guide portion.

8. The post-processing apparatus according to claim 1, wherein the guide includes an abutment portion on which the leading end of the sheet bundle abuts, and the abutment portion is inclined with respect to a direction in which the plurality of sheets are stacked in the sheet bundle.

9. The post-processing apparatus according to claim 1, further comprising an elevatable pressing member to press a sheet bundle to be bound by the binder in a direction in which the plurality of sheets are stacked in the sheet bundle.

10. The post-processing apparatus according to claim 1, wherein the guide has a guide wall surface on which an end surface of the sheet bundle is slidable with a longitudinal direction or a lateral direction of the sheet bundle as the manual feed direction.

11. The post-processing apparatus according to claim 1, wherein the guide has a first guide wall surface on which an end surface of the sheet bundle is slidable with a longitudinal direction of the sheet bundle as the manual feed direction, and a second guide wall surface on which an end surface of the sheet bundle is slidable with a lateral direction of the sheet bundle as the manual feed direction.

12. The post-processing apparatus according to claim 1, further comprising a detector to determine whether the sheet bundle has been guided by the guide.

13. The post-processing apparatus according to claim 12, further comprising a display to, before binding of the sheet bundle by the binder, display an image of a finished state of the sheet bundle in a case where the binding by the binder is completed, on a basis of a result of detection by the detector.

14. The post-processing apparatus according to claim 1, wherein the binder binds the sheet bundle with a staple.

15. The post-processing apparatus according to claim 1, wherein the binder includes a binding tool to bind the sheet bundle without using a staple.

16. The post-processing apparatus according to claim 1, further comprising a liquid impregnator to impregnate the leading end of the sheet bundle with liquid before the binder binds the sheet bundle.

17. The post-processing apparatus according to claim 16, further comprising an automatic processing device to:

stack a plurality of sheets fed into the post-processing apparatus to form a sheet bundle; and bind the sheet bundle, wherein the binder and the liquid impregnator are separately movable between the manual feed processing unit and the automatic processing device.

18. The post-processing apparatus according to claim 16, wherein the liquid impregnator is detachable from the post-processing apparatus.

19. An image forming system, comprising:

an image forming apparatus to form an image on a sheet; and the post-processing apparatus according to claim 1.

20. The image forming system according to claim 19, wherein the image forming apparatus includes an in-body space to which the sheet on which the image is formed is ejected and from which the sheet ejected is removable, and the post-processing apparatus is installed in the in-body space of the image forming apparatus.

* * * * *